United States Patent [19]

Komotzki

[11] Patent Number: 4,744,605

[45] Date of Patent: May 17, 1988

[54] BIT AND BIT HOLDER FOR MINING MACHINES

[76] Inventor: Michael Komotzki, Lichtendorfer Strasse 127, D-5840 Schwerte, Fed. Rep. of Germany

[21] Appl. No.: 893,100

[22] Filed: Aug. 4, 1986

[30] Foreign Application Priority Data

Aug. 2, 1985 [DE] Fed. Rep. of Germany ..... 3527707

[51] Int. Cl.[4] ..... E21B 10/62

[52] U.S. Cl. ..... 299/91; 299/93

[58] Field of Search ..... 299/91-93, 299/79; 37/142 R, 142 A

[56] References Cited

U.S. PATENT DOCUMENTS

| | | | |
|---|---|---|---|
| 599,732 | 3/1898 | Reeves | 299/93 |
| 1,140,173 | 5/1915 | Levin | 299/91 |
| 1,925,420 | 9/1933 | Van Buskirk | 37/142 R |
| 4,329,798 | 5/1982 | Edwards | 299/91 X |
| 4,607,891 | 8/1986 | Pendolino et al. | 229/91 X |
| 4,609,227 | 9/1986 | Wild et al. | 299/91 X |
| 4,625,439 | 12/1986 | Johansson et al. | 37/142 R |

FOREIGN PATENT DOCUMENTS

| | | | |
|---|---|---|---|
| 2319620 | 10/1974 | Fed. Rep. of Germany | 299/91 |
| 2617954 | 10/1977 | Fed. Rep. of Germany | 299/92 |
| 3439508 | 3/1986 | Fed. Rep. of Germany | 299/91 |
| 943 | 3/1869 | United Kingdom | 299/92 |

*Primary Examiner*—Stephen J. Novosad
*Assistant Examiner*—David J. Bagnell
*Attorney, Agent, or Firm*—Peter K. Kontler

[57] ABSTRACT

The holder for the bit of a mining machine has a chamber with an open side for introduction of the shank of the bit. The shank fills the chamber and one of its lateral surfaces has a longitudinally extending groove whose height and/or width decreases from a front opening to a rear opening of the holder. The groove is filled by the stem of a key which holds the shank in the chamber. The rear end of the stem extends into the rear opening, and the front end of the stem extends forwardly through and beyond the front opening and carries a head which facilitates extraction or expulsion of the key.

10 Claims, 1 Drawing Sheet

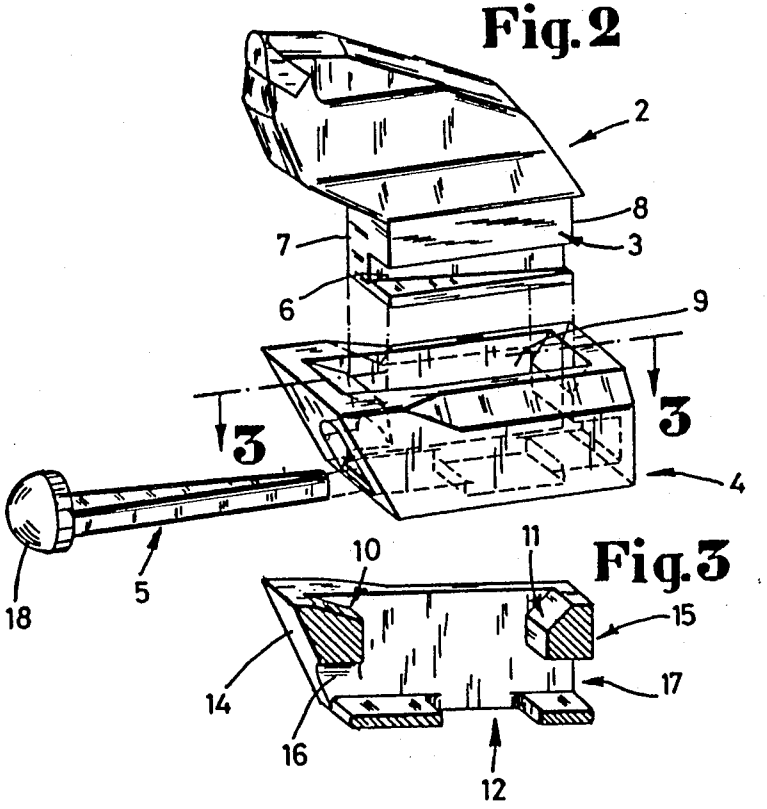
Fig.2
2
8
3
9
4
3
7
6
3
5
18
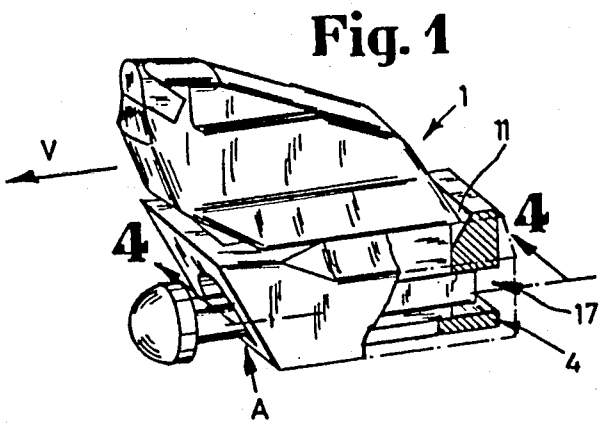
Fig.1
1
11
4
17
4
A
4
V
Fig.3
15
17
11
12
10
16
14
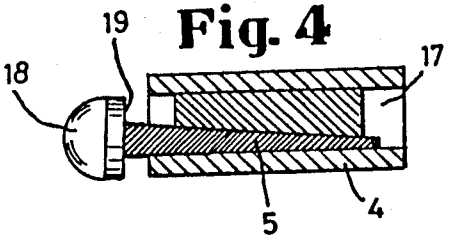
Fig. 4
17
4
5
19
18

BIT AND BIT HOLDER FOR MINING MACHINES

BACKGROUND OF THE INVENTION

The present invention relates to material removing tools in general, and more particularly to improvements in material removing tools which can be used in mining and other material removing machines. Still more particularly, the invention relates to improvements in material removing tools of the type wherein a holder is provided with a chamber for the shank of a bit and the shank is releasably held in the chamber by a cotter, a wedge or the like.

The tool which is used in the mining machine for removal of coal or another mineral from the face of a mine in an underground excavation or in surface mining normally comprises a bit with a cutting edge which comes into actual contact with the material to be removed. The bit has a solid shank extending into the chamber of a holder which is removably or permanently secured to the conveyor of the machine, such as an endless chain, a wheel or the like. Means is provided for releasably attaching the bit to the holder so as to ensure that the shank will remain in the chamber while the cutting edge of the bit removes material from the mine face. It is also known to employ screws, bolts or other threaded elements which releasably secure the bit to its holder.

A drawback of many conventional bit and holder combinations is that the attachment of the bit to, or its detachment from, the holder is a time-consuming operation which often requires the utilization of specially designed tools. On the other hand, it is desirable to ensure that the bit can be readily detached from its holder because the useful life of the bit is much shorter than that of the holder. Since such replacement of bits often takes place in an underground excavation where the illumination is unsatisfactory, the establishment of a reliable but readily separable connection between the bit and the holder is even more important. Still further, the nature of the connection between the holder and the bit should be such that the connection can be terminated or established even if the holder and the bit are not readily accessible in an excavation or the like.

In accordance with a presently known proposal, the shank of the bit constitutes an elongated body which is receivable in a chamber of the holder and has a rear end portion provided with a projection receivable in a recess of the holder so that the shank can be pivoted about the projection toward and from a position in which it is properly received in the chamber of the holder. The front portion of the properly inserted shank is thereupon bolted or screwed to the adjacent portion of the holder.

Pivotal mounting of the shank in the holder is not entirely satisfactory because any, even slightest, stray movements of the shank relative to the holder entail pronounced wear upon the shank and upon the adjacent portion of the holder. This allows for additional stray movements and for even more pronounced wear with attendant danger that the shank will leave its chamber or that the head of the bit will break away from the shank.

U.S. Pat. No. 1,140,173 to Levin discloses a bit holder for mining machines wherein the shank of the bit is provided with a row of teeth in each of its lateral surfaces and is received in a narrow chamber of the holder to cooperate with a wedge-like toothed key whose teeth can be placed into mesh with the teeth at one side of the shank. The width of the shank equals its length (as considered in the direction of forward movement of the chain conveyor which carries the bit holder), and the provision of tooth spaces in both sides of the shank entails a pronounced weakening of the shank so that the head of the bit is likely to break away when its cutting edge encounters a pronounced resistance to forward movement.

An additional drawback of the patented bit holder is that the making of teeth and tooth spaces in both sides of the shank of the bit as well as in the key involves a substantial amount of precision work with attendant increased cost of the tool.

OBJECTS AND SUMMARY OF THE INVENTION

An object of the invention is to provide a novel and improved combination of a bit and bit holder which can be used with advantage in mining machines, e.g., to remove coal from the mine face.

Another object of the invention is to provide a combined bit and bit holder which can stand long periods of use and ensures reliable and predictable retention of the bit in the holder.

A further object of the invention is to provide a mining or another material removing machine which embodies the improved bit and bit holder.

An additional object of the invention is to provide a bit and bit holder combination which is constructed and assembled in such a way that the bit can be reliably secured to or detached from the holder in a simple and time-saving operation irrespective of whether the operation is carried out in daylight or in a dimly lit or dark underground excavation.

Still another object of the invention is to provide a bit and bit holder combination which can be properly manipulated by skilled, semiskilled or even unskilled persons and whose manipulation necessitates the utilization of simple and readily available implements.

An additional object of the invention is to provide a bit and bit holder combination which can be installed on the conveyors (such as chains or wheels) of existing mining or other material removing machines.

A further object of the invention is to provide novel and improved means for reliably but releasably holding the bit in its holder.

An additional object of the invention is to provide a novel and improved bit and a novel and improved bit holder for use in mining and like machines.

The invention resides in the provision of a material removing machine, particularly a mining machine. More specifically, the invention resides in the combination of a holder which is movable in a predetermined direction and defines a preferably elongated chamber extending in the predetermined direction and having an open side. The chamber has a substantially square or rectangular cross sectional outline and the holder is further formed with a front opening and a rear opening. The openings communicate with the respective ends of the chamber. The bit of the improved combination has a shank which extends through the open side of and into the chamber. The shank has a lateral surface which is provided with a groove extending in the direction of forward movement of the holder and tapering in such direction all the way from the front opening to the rear opening of the holder. The means for releasably locking or retaining the shank in the holder includes a key having a tapering stem which fills the groove and is in frictional engagement with the shank as well as with the holder. The rear portion of the stem preferably extends into the rear opening, and a front portion of the stem preferably extends into the front opening of the holder. The front portion of the stem preferably extends forwardly beyond the front opening of the holder, and the key further comprises a head which is rigid or integral with the front portion of the stem and has a rear side or end face extending substantially at right angles to the predetermined direction. Such rear side or end face is accessible to the working end of a suitable implement even when the major part of the stem of the key completely fills the groove in the lateral surface of the shank. The taper of the stem in the groove is preferably between approximately 3.5° and 5°.

The chamber is preferably elongated in the predetermined direction and has a rectangular cross-sectional outline in such direction. The chamber is at least substantially filled by the shank of the bit, and the width of such chamber (as measured transversely of the predetermined direction) preferably equals or approximates the width of the front and/or rear opening of the holder.

The holder can be provided with front and rear facets which flank the respective ends of the open side of the chamber. These facets are in contact with complementary facets of the shank when the latter is properly received in the chamber.

The configuration of the stem of the key is preferably such that its width and/or height decreases gradually all the way from the head of the key to the rearmost portion of the stem. The front side of the holder can be inclined with reference to the predetermined direction so as to further facilitate access to the rear side or rear end face of the head of the key.

The novel features which are considered as characteristic of the invention are set forth in particular in the appended claims. The improved bit and bit holder themselves, however, both as to their construction and the mode of assembling the same, together with additional features and advantages thereof, will be best understood upon perusal of the following detailed description of certain specific embodiments with reference to the accompanying drawing.

BRIEF DESCRIPTION OF THE DRAWING

FIG. 1 is a perspective view of the assembled bit and bit holder, with a portion of the bit holder broken away;

FIG. 2 is an exploded perspective view of the bit and bit holder;

FIG. 3 is a vertical sectional view of the bit holder in the plane of the phantom line and arrows 3 in FIG. 2; and FIG. 4 is a horizontal sectional view as seen in the plane of the phantom line and arrows 4 in FIG. 1.

DESCRIPTION OF THE PREFERRED EMBODIMENTS

The improved bit and bit holder combination comprises a one-piece bit or cutter 1 having a cutter head 2 and a shank 3. The direction in which the bit 1 advances when the improved combination is installed in a mining or other material removing machine (not specifically shown) is indicated by the arrow V. When the parts of the improved combination are properly assembled, the shank 3 of the bit 1 extends into and fills a chamber 9 which is provided in a bit holder 4. The means for releasably retaining the shank 3 in the chamber 9 comprises an elongated wedge-like key 5.

The shank 3 of the bit 1 is integral with the cutter head 2 and has a parallelepiped outline. One lateral surface of the shank 3 is formed with an elongated groove 6 which extends all the way from the front side 7 to the rear side 8 of the shank and whose width and/or height decreases gradually in a direction from the side 7 to the side 8. The upper side of the chamber 9 in the holder 4 is open (see particularly FIG. 3), and such open side is flanked by two facets 10, 11 of the holder. The front side 14 of the holder 4 slopes rearwardly and downwardly and is provided with a front opening 16 having a width corresponding to that of the chamber 9. The rear side 15 of the holder 4 is also provided with an opening 17 which extends all the way between the two lateral walls of the holder 4, i.e., which has the same width as the chamber 9. The bottom opening 12 of the holder 4 can receive a projection of the conveyor (such as a chain or a wheel) to which the holder is attached when the improved bit and holder combination is in actual use.

The maximum cross-sectional area of the groove 6 is adjacent the front side 7 and the minimum cross-sectional area of the groove 6 is adjacent the rear side 8 of the shank 3. The upper portion of the shank 3 has two facets which are complementary to the facets 10, 11 of the holder 4 so as to ensure that the material of the shank 3 fills the entire chamber 9 when the parts 1 and 4 are properly assembled with each other. The purpose of the facets 10, 11 is to facilitate rapid introduction of the shank 3 into the chamber 9. This is of particular importance if the insertion has to take place in an underground excavation which is dimly lit or is not lit at all.

The key 5 has an elongated wedge-like stem which fills the groove 6 in the lateral surface of the shank 3 when the key is properly inserted into the holder 4. The rearmost portion of the stem of the key 5 extends into the rear opening 17 of the holder 4, and the foremost portion of the stem extends through and forwardly beyond the front opening 16 of the holder 4. The foremost portion of the stem is integral with a substantially semispherical head 18 having a rear end face 19 which is preferably normal to the direction (arrow V) of forward movement of the improved tool when the bit 1 is in actual use. The clearance A between the downwardly and rearwardly sloping front side 14 of the holder 4 and the end face 19 allows for insertion of a rudimentary implement which is used to extract the key 5 from the groove 6 preparatory to extraction of the shank 3 from the chamber 9. Any impact against the head 18 (while the bit 1 moves in the direction of the arrow V) will tend to cause deeper penetration of the stem of the key into the groove 6 so as to further reduce the likelihood of any stray movements of the shank 3 relative to the holder 4 and/or vice versa and to practically exclude the possibility of complete separation of the bit 1 from the holder. The sides of the stem of the key 5 are in desirable pronounced frictional engagement with the surfaces surrounding the groove 6 as well as with the adjacent internal surface of the holder 4. The rearmost portion of the stem of the key 5 is in frictional engagement with the adjacent surface in the rear opening 17 of the holder 4, and the same applies for the foremost portion of the stem immediately behind the end face 19 in the interior of the front opening 16. The height of the openings 16 and 17 can be selected in such a way that it equals the height of the corresponding portions of the stem of the key 5. This even further reduces the likelihood of wobbling of the key in the groove 6 and/or wobbling of the shank 3 in the chamber 9.

In the illustrated embodiment, the width of the stem of the key 5 decreases in a direction from the rear end face 19 of the head 18 toward the rearmost end of the stem. The taper is preferably between approximately 3.5° and 5°. Such taper is somewhat exaggerated in the drawing for the sake of clarity. If desired, the key 5 can be provided with a stem which tapers in two directions, namely in a manner as shown in FIG. 2 as well as in such a way that its height decreases in a direction from the head 18 toward the rear opening 17. Alternatively, the height of the stem of the key 5 may decrease while its width (as measured transversely of the direction indicated by the arrow V) remains constant. The dimensions of the stem of the key 5 are selected in such a way that the head 18 and the holder 4 define the clearance A even when the stem completely fills the groove 6 of the shank 3. This ensures that, whenever necessary, the key 5 can be rapidly extracted or expelled from the holder 4 so as to allow for extraction of the shank 3 from the chamber 9.

The manner in which the holder 4 is or can be secured to a chain, wheel or the like forms no part of the present invention. In accordance with a presently preferred embodiment, the configuration of the chamber 9 and shank 3 is such that the shank has a square or rectangular cross-sectional outline in a plane which extends at right angles to the direction of the arrow V and that the shank has a rectangular outline in a plane which is parallel to the direction indicated by the arrow V. When the shank 3 is inserted into the chamber 9, it is automatically held against movement relative to the holder 4 in two directions, namely in and counter to the direction which is indicated by the arrow V as well as transversely of such direction. Any movement in the third direction, namely upwardly as seen in FIG. 1, is prevented as soon as the stem of the key 5 is properly introduced into the groove 6.

An important advantage of the improved bitholder combination is that it can be manipulated by semiskilled or unskilled persons. Furthermore, the shank 3 can be inserted into and releasably locked in the holder 4 or extracted or expelled from the holder by resorting to rudimentary implements and regardless of the intensity of illumination of the machine in which the improved combination is put to use.

An advantage of the feature that the rearmost portion of the stem of the key 5 extends into the rear opening 17 of the holder 4 is that the area of frictional engagement between the key and the holder is increased as well as that, if necessary, the key can be expelled by striking against the rearmost portion of its stem in a direction corresponding to that which is indicated by the arrow V. Pronounced frictional engagement between the foremost portion of the stem of the key 5 and the holder 4 in the front opening 16 also contributes to a more reliable retention of the key in the groove 6 and to a more reliable retention of the shank 3 in the chamber 9.

A further important advantage of the improved bitholder combination is that the shank 3 of the bit 1 is not unduly weakened by the provision of the wedgelike groove 6. It has been found that the provision of a single groove weakens the shank much less than the provision of teeth and tooth spaces at one or both sides of the shank as disclosed in the aforementioned U.S. Pat. No. 1,140,173 to Levin. Furthermore, the making of a single groove which extends all the way from the front side 7 to the rear side 8 of the shank 3 is much less expensive and less time-consuming than the making of teeth and tooth spaces at one or both sides of the shank. The improved key 5 need not be provided with any teeth and/or tooth spaces.. The entire combination is relatively inexpensive because none of its parts must be shaped, machined and/or otherwise treated with a high degree of precision.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a material removing machine, particularly in a mining machine, the combination of a holder movable in a predetermined direction and defining a chamber extending in said direction and having an open side, said chamber having a substantially square or rectangular cross-sectional outline and said holder further having a front opening and a rear opening, said openings communicating with said chamber; a bit having a shank extending through the open side of and into said chamber, said shank having a surface provided with a groove extending in said direction and tapering from said front opening toward said rear opening; and means for releasably locking said shank to said holder including a key having a tapering stem filling said groove and being in frictional engagement with said shank and said holder.

2. The combination of claim 1, wherein said stem has a rear portion extending into said rear opening and a front portion in said front opening.

3. The combination of claim 2, wherein the front portion of said stem extends forwardly beyond said front opening and said key further comprises a head rigid with the front portion of said stem and having a rear side extending substantially at right angles to said direction.

4. The combination of claim 1, wherein the taper of said stem in said groove is between approximately 3.5 and 5 degrees.

5. The combination of claim 1, wherein said chamber is elongated is said direction and has a rectangular cross-sectional outline in said direction, said chamber being at least substantially filled by said shank and having a predetermined width, the width of at least one of said openings being equal to or approximating said predetermined width.

6. The combination of claim 1, wherein said holder has front and rear facets flanking the open side of said chamber.

7. The combination of claim 1, wherein at least one of the dimensions including the width and the height of said stem and the width and the height of said groove decreases continuously counter to said direction from said front opening to said rear opening.

8. The combination of claim 1, wherein said shank is a parallelepiped.

9. The combination of claim 1, wherein said holder has a front side which is inclined with reference to said direction, said front side sloping counter to said direction.

10. In a material removing machine, particularly in a mining machine, the combination of a holder movable in a predetermined direction and defining a chamber of substantially rectangular cross-sectional outline which is elongated in said direction, said chamber having an open side and said holder being provided with a pair of facets which flank said open side and are inclined towards said chamber, said holder being further provided with a front opening and a rear opening which communicate with said chamber, and each of said openings having a width which at least approximates the width of said chamber; a one-piece bit having a substantially parallelepipedal shank designed to be snugly received in said chamber via said open side, said shank being provided with a groove which is arranged to extend in said diretion and said groove having a taper such that said groove narrows from said front opening toward said rear opening when said shank is in said chamber; and means for releasably locking said shank to said holder including a key provided with a stem which is insertable into said groove via said front opening when said shank is in said chamber, said stem having a taper complementary to that of said groove and being designed to frictionally engage said shank and said holder, and said stem having a length such that a rear portion of said stem extends into said rear opening and a front portion of said stem is located outwardly of said front opening when said stem is in said groove, said key further including a head rigid with said front portion of said stem and having a rear side which is substantially normal to said direction when said stem is in said groove.

* * * * *